US005275791A

United States Patent [19]

Knorre et al.

[11] Patent Number: 5,275,791

[45] Date of Patent: Jan. 4, 1994

[54] PROCESS FOR THE LEACHING OF GOLD AND SILVER WITH CYANIDIC LEACHING SOLUTION AND CONTROLLED ADDITION OF HYDROGEN PEROXIDE

[75] Inventors: Helmut Knorre, Seligenstadt, Fed. Rep. of Germany; Andrew Griffiths, Ridgewood, N.J.; Juergen Loroesch, Hanau; Joachim Fischer, Rodenbach, both of Fed. Rep. of Germany

[73] Assignee: Degussa Aktiengesellschaft, Frankfurt am Main, Fed. Rep. of Germany

[21] Appl. No.: 899,060

[22] Filed: Jun. 16, 1992

Related U.S. Application Data

[63] Continuation of Ser. No. 672,159, Mar. 20, 1991, abandoned, which is a continuation of Ser. No. 394,236, Aug. 10, 1989, abandoned, which is a continuation of Ser. No. 113,697, Oct. 28, 1987, abandoned.

[30] Foreign Application Priority Data

Oct. 31, 1986 [DE] Fed. Rep. of Germany ..... 3637082

[51] Int. Cl.[5] ..... C01G 5/00; C01G 7/00; C22B 11/08

[52] U.S. Cl. ..... 423/29; 423/31

[58] Field of Search ..... 75/744; 423/27, 29, 423/30, 31

[56] References Cited

U.S. PATENT DOCUMENTS

| | | | |
|---|---|---|---|
| 732,605 | 6/1903 | Thede | 423/29 |
| 3,826,723 | 7/1974 | Woods et al. | 204/110 |
| 4,421,724 | 12/1983 | Hunnel | 423/31 |
| 4,578,163 | 3/1986 | Kunter et al. | 204/110 |
| 4,971,625 | 11/1990 | Bahr | 75/744 |

FOREIGN PATENT DOCUMENTS 1221842 5/1987 Canada .

OTHER PUBLICATIONS

Day, E. L. "Some Factors Influencing the Rate of Dissolution of Gold in Sodium Cyanide Solutions" Canadian Mining Journal, Aug. 1967, pp. 55–60.

Davidson, R. J., et al., "The Intensive Cyandation of Gold-Plant Gravity Concentrates, J. of S. African Inst. of Min. and Met."; Jan. 1978 pp. 146–165.

Dorr, J. V. N., et al., "Cyanidation and Concentration of Gold and Silver Ores" 1950, Second Edition, pp. 216–218.

Woodcock, J. T., et al., "Oxygen Concentrations, Redox Potentials, Xanthate Residuals, and Other Parameters in Floatation Plant Pulps", in *Mineral Processing and Extractive Metallurgy: Proceedings of the Ninth Commonwealth/Mining and Metallurgical Congress* 1969, vol. 3, 1970, pp. 439–468.

Jones, M. H., et al., "Evaluation of Ion-Selective Electrode for Control of Sodium Sulphide Additions During laboratory Floatation of Oxidized Ores", pp. C99–C105, published Jun. 1978.

(List continued on next page:)

*Primary Examiner*—Michael Lewis
*Assistant Examiner*—Steven Bos
*Attorney, Agent, or Firm*—Beveridge, DeGrandi, Weilacher & Young

[57] ABSTRACT

A process is described for leaching gold and/or silver from ores or ore concentrates using an aqueous alkaline cyanide solution with addition of hydrogen peroxide. The addition of the aqueous $H_2O_2$ solution is regulated and controlled through the concentration of the oxygen dissolved in the leaching solution, the leaching solution containing from 2 to 20 mg $O_2$ and preferably from 7 to 13 mg $O_2$ per liter. 0.5 to 5% by weight $H_2O_2$ solutions are preferably added. The process is applicable both to leaching by agitation and to heap leaching, the addition of $H_2O_2$ being regulated and controlled through measurement of the $O_2$ concentration in the leaching solution and can also involve measurement in a measuring stream. Despite low consumptions of $H_2O_2$ and NaCN, the gold yield is even increased in some cases and the leaching time shortened.

15 Claims, 1 Drawing Sheet

OTHER PUBLICATIONS

Peck, R. C., thesis entitled "Peroxides in the Cyanide Leaching of Gold and Silver Ores" submitted in Fulfilment of the Requirements for the Degree of Doctor of Philosophy at the University of Leeds, Department of Mining and Mineral Engineering, Dec. 1980.

Julian, H. F., et al., *Cyaniding Gold and Silver Ores: A Practical Treatise on the Cyanide Process,* 1904, pp. 73-76.

Jones, M. H., et al., "Perxanthates—A New Factor in the Theory and Practice of Floation", *International J. of Mineral Processing* (1978), vol. 5, pp. 285-296.

Fraser, G. M., "Aeration Desing for Gold Ore Leaching", pp. 245-256, presented at the Australlasian Institute of Mining and Metallurgy, Perth and Kalgoorlic Branches Regional Conference on Gold-Mining, Metallurgy and Geology, Oct. 1984.

Haigh, C. J., et al., "Residue Treatment Plant Practice at Risdon, Tasmania", pp. 339-349, presented at the Australlasian Institute of Mining and Metallurgy Conference, Tasmania, May 1977.

Day, E. L., "Some Factors Influencing the Rate of Dissolution of Gold in Sodium Cyanide Solutions", *Canadian Mining Journal* (Aug. 1967), pp. 55-60.

Cathro, K. J., "The Effect of Oxygen in the Cyanide Process for Gold Recovery", pp. 181-205, Division of Mineral Chemistry, Commonwealth Scientific and Industrial Research Organization, May, 1963.

Fahrenwald, A. W., et al., "Some Studies on the Gold-Dissolution Rate in Cyanide Solutions", *Engineering and Mining Journal,* vol. 140, pp. 44-46, 1939.

*Mining Engineering* (May 1983), pp. 517-519, vol. 35(5).

Norris, R. D., et al., "The Use of Peroxygen Chemicals in the Heap Leaching of Gold and Silver Ores", SME-AIME Annual Meeting, Mar. 6-10, 1983, Atlanta, Ga.

Garcia, R. M., "The Recovery of Silver from Photographic Film: A Study of the Leaching Reaction with Cyanide Solution for Industrial Use", *Hydrometallurgy* (1986), vol. 16, pp. 395-400.

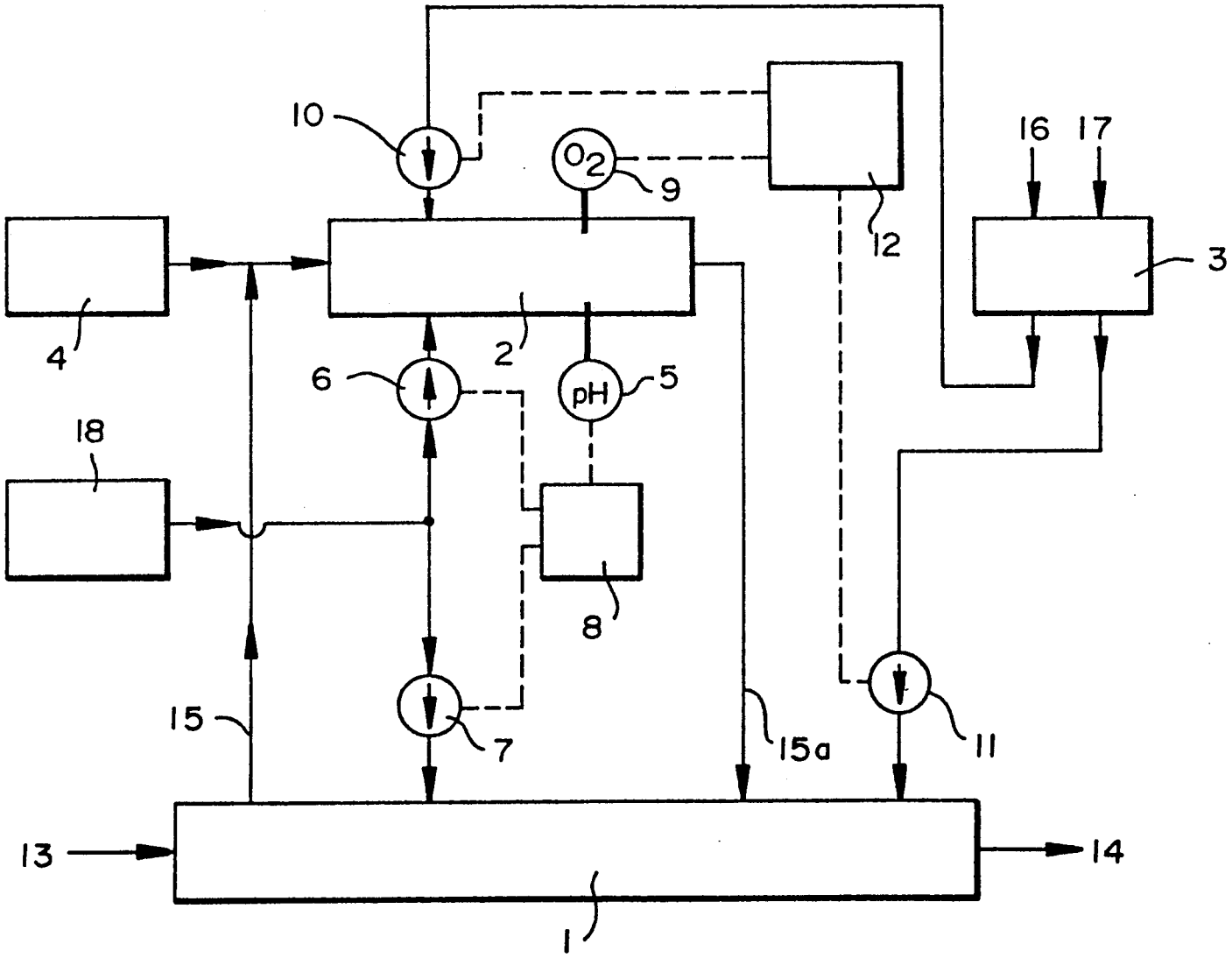
3
17
16
12
9
$O_2$
10
2
5
pH
8
6
7
4
18
15
15a
11
14
13
1

PROCESS FOR THE LEACHING OF GOLD AND SILVER WITH CYANIDIC LEACHING SOLUTION AND CONTROLLED ADDITION OF HYDROGEN PEROXIDE

This application is a continuation of application Ser. No. 07/672,159, filed Mar. 20, 1991, now abandoned, which in turn is a continuation of application Ser. No. 07/394,236, filed Aug. 10, 1989, now abandoned, which in turn is a continuation of Ser. No. 07/113,697 filed Oct. 28, 1987, now abandoned.

BACKGROUND AND INTRODUCTION

This invention relates to a process for leaching noble metals, essentially gold and/or silver, from ores or ore concentrates using an aqueous, alkaline cyanide solution with addition of hydrogen peroxide as oxidizing agent.

It is known that noble metals can be leached with a cyanide-containing solution and, at the same time, converted into soluble cyano complexes. Since the gold in gold ores is mostly present in elemental form, an oxidizing agent is required for the dissolving process. The oxidizing agent used in gold mining is generally atmospheric oxygen. The following equation represents the known reaction:

$$4\,Au + 8\,CN^- + O_2 + 2\,H_2O \rightarrow 4\,[Au(CN)_2]^- + 4\,OH^-$$

To this end, the finely ground ore is suspended in water, a pH value of from 9 to 12 and preferably from 10 to 11 is adjusted by addition of lime and an aqueous cyanide solution is added. The ore pulp is then stirred for up to 48 hours in one or more cylindrical stirring vessels arranged in the form of a cascade and, at the same time, is gassed with air introduced through nozzles.

However, leaching by agitation, which has been practiced for almost 100 years now, is attended by certain disadvantages; namely:

The oxidation of the noble metal by dissolved oxygen is the speed-determining factor in the dissolution of the noble metal in cyanide-containing solutions. Due to the enormous dimensions of the leaching tanks in use today (up to 3000 $m^3$) and to the viscosity of the ore pulp, adequate mixing is not often achieved, so that the maximum content of dissolved $O_2$ determined by the $O_2$ partial pressure of the air (8–9 ppm $O_2$ is the saturation limit) is not reached (cf. Example 3a).

The gassing with air means that a more or less large quantity of HCN is always discharged from the ore pulp. As a result, not only is the cyanide demand increased, the safety of the person in charge and the environment are also affected.

The carbon dioxide in the air reduces the pH value of the pulp. As a result, the equilibrium $$CN^- + H_2O \rightleftharpoons HCN + OH^-$$

is displaced towards the free hydrocyanic acid. The result of this is that the lime consumption increases and more hydrocyanic acid is discharged with the air. In addition, calcium carbonate is formed, leading to unwanted deposits on the tank walls, pipes and, in particular, on the active carbon which is often used in the second stage of the process for separating gold. The consequences of such deposits on the carbon are operational disruptions and losses of noble metal.

As a result of the gassing with air, compressor oil can enter the leaching tanks, resulting in smearing of the surface of the active carbon which is used in the CIP process. Operational disruptions and losses of noble metal are again the outcome.

The operating costs of the compressors are a function of the tank height on account of the hydrostatic pressure. Accordingly, the leaching tanks used today, which are up to 20 meters in height, involve increased costs.

In addition to leaching by agitation, so-called heap leaching is used to leach noble metals with a cyanide-containing solution. To this end, large heaps of ore (generally 3 to 10 meters in height) are sprayed with an aqueous cyanide-containing leaching solution having a pH of from 8 to 13. The ore-free leaching solution issuing from the bottom of the heap is circulated, part of the leaching solution being continuously removed from the circuit for the separation of noble metal and replaced by fresh leaching solution.

A serious disadvantage of heap leaching is that the atmospheric oxygen required to oxidize the noble metal in the ore heap has to be introduced into the ore heap by the leaching solution. Since the concentration of dissolved oxygen in the leaching solution decreases to a considerable extent from the top to the bottom of the ore heap, leaching is never complete, above all in the lower regions. This fact is responsible for the generally very low gold yield (40 to 60% of the gold present in the ore) in heap leaching.

In view of these problems, various attempts have already been made to use other oxidizing agents instead of atmospheric oxygen in the leaching of gold, for example permanganates, persulfates, peroxides, ozone, chromates and dichromates, ferricyanides, cyanogen bromide and bromine chloride and also hydrogen peroxide. Although these oxidizing agents are capable of increasing the dissolving rate of the gold by comparison with atmospheric oxygen, they have not yet been able to replace atmospheric oxygen because economic use could not be guaranteed. In addition, some of the oxidizing agents mentioned and/or reaction products emanating therefrom are highly toxic, so that the use of these compounds could not be seriously considered on account of possible environmental pollution and the necessary measures to avoid such pollution.

In environmental terms, hydrogen peroxide, which has also been investigated as an oxygen donor or oxidizing agent, is the most suitable oxidizing agent for replacing atmospheric oxygen, because only water and oxygen and no toxic products are formed in the decomposition of $H_2O_2$. However, the industrial use of $H_2O_2$ has hitherto been prevented both by its inadequate effectiveness and by the economy factor. The economy factor can be adversely affected inter alia by the fact that, under certain conditions, $H_2O_2$ is also capable of oxidizing the cyanide, resulting in an excessive consumption of $H_2O_2$ and of cyanide.

Another problem is that $H_2O_2$ can inhibit the dissolving process through passivation of the gold surface.

In U.S. Pat. No. 3,826,723, there is described a process for the cyanide leaching of gold and/or silver with addition of hydrogen peroxide. The hydrogen peroxide is shown to be added in the form of stabilized $H_2O_2$, preferably as a 50% solution, in a quantity corresponding to 0.3 to 15 g $H_2O_2$ per liter leaching solution, as calculated from the data in lines 51 to 53, column 2, of the cited U.S. patent, and 1.2 g/ml for the density of the 50% by weight $H_2O_2$. According to the only example, in this cited U.S. patent, gold was leached from an ore in a shorter time and in a higher yield, the leaching solution containing 60 g NaCN and 5 ml stabilized 50% $H_2O_2$ per liter, than was possible in conventional leaching with atmospheric oxygen as the oxidizing agent. However, such high cyanide concentration (1 to 600 g NaCN/1 leaching solution according to the U.S. patent) completely jeopardize the economy of the process. This is so because, after leaching and separation of the gold, the leaching solution obtained, which is still rich in cyanide, has to be detoxified for example using $H_2O_2$. Recycling of the leaching solution is not possible in practice because disruption of the leaching process through accumulations of other metals could no longer be ruled out.

Comparison tests were carried out in accordance with the process described in the said U.S. Pat. No. 3,826,723, a gold ore being leached and the leaching solution containing sodium cyanide in a concentration which had proved to be suitable in the standard process where air is used for gasing. Comparison Example 1 (hereinafter below) shows that the gold yield remains far below the value obtained in the standard process if at the beginning the leaching solution contains 0.033% by weight sodium cyanide and 0.023% by weight hydrogen peroxide added in the form of 35% by weight aqueous $H_2O_2$. Under these conditions, therefore, economic leaching was not possible.

E. L. Day (Canadian Mining Journal, August 1967, pages 55–60) investigated a model system for dissolving a gold foil in leaching solutions containing NaCN and $H_2O_2$. According to those investigations, the dissolving rate follows a non-uniform trend as a function of the NaCN and $H_2O_2$ concentration of the leaching solution. The maximum dissolving rate was obtained with a leaching solution containing 0.025% NaCN and approximately 0.02% $H_2O_2$. However, this model only takes into account the dissolving rate of a gold foil in the first 5 to 30 minutes and does not enable any conclusions to be drawn as to the gold yield, the demand for sodium cyanide and hydrogen peroxide and the dissolving rate of gold from gold ores. Although a leaching solution of which the cyanide and $H_2O_2$ concentration was in the optimal range of the model system was used in the Comparison Example, as explained above, the process proved to be impracticable in economic terms.

SUMMARY OF THE INVENTION

Accordingly, it is an object of the present invention to provide an improved process for the leaching of noble metals with controlled addition of hydrogen peroxide. More particularly, it is an object of the invention to ensure that, for as low a consumption of $H_2O_2$ as possible, the consumption of sodium cyanide is no higher than in the conventional leaching process where air is used for gassing. In addition, the improved process according to the invention is intended to be able to be safely controlled, even on an industrial scale, without the disadvantages of the conventional process.

The above as well as other objects are achieved by a process for leaching gold and/or silver from ores or ore concentrates using an aqueous cyanide-containing leaching solution having a pH value of from 8 to 13 with addition of an aqueous $H_2O_2$ solution, characterized in that the addition of the aqueous $H_2O_2$ solution is regulated and controlled through the concentration of the oxygen dissolved in the leaching solution, the leaching solution containing from 2 to 20 mg $O_2$ per liter.

BRIEF DESCRIPTION OF THE DRAWINGS

The invention will be further understood with reference to the drawing which shows a flow diagram of the process of the invention.

DETAILED DESCRIPTION OF THE INVENTION

It has surprisingly been found that hydrogen peroxide may be economically used for leaching ores providing the addition of $H_2O_2$ is regulated and controlled in dependence upon the $O_2$ concentration in the leaching solution. The $O_2$ concentration should be from 2 to 20 mg $O_2$ and preferably from 7 to 13 mg $O_2$ per liter leaching solution. The dissolved oxygen in the leaching solution emanates from the decomposition of the $H_2O_2$ added, although some of the dissolved oxygen may even enter the leaching solution through the uptake of atmospheric oxygen, for example in the production of an ore pulp during the intensive circulation thereof during leaching or, in the case of heap leaching, during the spraying of the leaching solution. In the case of leaching of an ore pulp by agitation, the leaching solution is understood to be the aqueous phase of the ore pulp. The $O_2$ concentration to be measured in order to regulate and control the addition of $H_2O_2$ depends on how quickly the $H_2O_2$ added decomposes and how quickly the dissolved oxygen formed from $H_2O_2$ and otherwise introduced is consumed.

In principle, dilute or concentrated, for example 35 to 70% by weight, aqueous $H_2O_2$ solutions may be used to control and to maintain the desired $O_2$ concentration.

However, it has surprisingly been found that leaching may be carried out particularly economically; i.e. with low consumptions of $H_2O_2$ and NaCN, if the $H_2O_2$ is added in the form of a dilute aqueous solution. $H_2O_2$ concentrations of from 0.5 to 5% by weight and preferably from 1 to 2% by weight are particularly suitable. Although the stabilizers normally used are also diluted along with the $H_2O_2$, the decomposition of the $H_2O_2$ in the presence of the ore to be leached is surprisingly not accelerated, but actually decelerated. As a result, the $H_2O_2$ can be thoroughly distributed in the pulp in leaching by agitation without any losses of active oxygen. Where leaching is carried out in accordance with Example 2 of the present invention, the consumption of $H_2O_2$ falls to one tenth for substantially the same gold yield where a 1.0% by weight $H_2O_2$ solution is used instead of a 35% by weight $H_2O_2$ solution.

Where concentrated $H_2O_2$ solutions are used, the sodium cyanide is in danger of being oxidized, as indicated above, resulting in a higher consumption both of $H_2O_2$ and of NaCN. Clearly, it is important that the $H_2O_2$ concentration in the leaching solution is also kept low temporarily and locally. In heap leaching, the addition of a $H_2O_2$ solution of relatively high concentration to the ore-free leaching solution generally does not present any major problems, because intermixing and adjustment of a low $H_2O_2$ concentration in the leaching solution take place sufficiently quickly. By contrast, the homogeneous intermixing of an $H_2O_2$ solution of relatively high concentration with an ore pulp of possibly high viscosity takes a relatively long time and losses of $H_2O_2$ and NaCN can no longer be ruled out. In general, an $H_2O_2$ concentration in the leaching solution of 0.05% by weight should not be exceeded. The $H_2O_2$ concentration is preferably kept below 0.03% by weight and more preferably below 0.02% by weight during the leaching process. In general, the $H_2O_2$ concentration in the leaching solution will remain below 0.03% by weight if the addition of $H_2O_2$ is regulated through the $O_2$ concentration (2–20 mg $O_2$/l) and providing there is no significant $H_2O_2$ concentration gradient in the leaching solution or the ore pulp. The expert will determine the $H_2O_2$ concentration in the leaching solution in preliminary tests and will select that $H_2O_2$ concentration for the leaching process which gives the greatest economy in practical application.

Where dilute $H_2O_2$ solutions are used, the dissolving rate of gold normally exceeds that in conventional leaching where air is used for gassing, at least in the initial phase of the leaching process. Depending on the gold ore in question, substantially the same maximum gold yield is obtained in both processes, the necessary leaching time sometimes being considerably shorter in the process according to the invention (cf. Examples 1b) and 3a) with Examples 2 and 3b) of the invention).

The $O_2$ concentration in the aqueous phase of the ore pulp is preferably kept constant during leaching within the range of variation inherent in the process and its control systems. The $O_2$ concentration should be in the range from 2 to 20 mg, preferably in the range from 5 to 15 mg and more preferably in the range from 7 to 13 mg $O_2$ per liter of aqueous phase. The control-related variations may emanate, for example, from the inertia of the $O_2$ concentration measurement by means of an $O_2$ electrode; process-related variations are inter alia the result of differences in concentration occurring in large stirring vessels.

The addition of the $H_2O_2$ solution is controlled in dependence upon the $O_2$ concentration. An oxygen electrode chain may advantageously be used for this purpose.

In principle, leaching may be carried out in the presence of atmospheric oxygen dissolved in the leaching solution before, during or after leaching with addition of $H_2O_2$. However, where the process according to the invention is combined with the conventional leaching process where air is used for gassing, it is preferred, that the increased demand for active oxygen in the first phase of the leaching process is covered by addition of hydrogen peroxide in accordance with the invention, gassing with air only being carried out in the second phase.

The addition of the $H_2O_2$ solution in dependence upon the concentration of oxygen dissolved in the aqueous phase of the ore pulp can no longer be continuously regulated and controlled with satisfactory accuracy if the measurement of the $O_2$ concentration is carried out in the generally very large leaching tank. The reasons for this include, inter alia, the excessively long mixing time of the $H_2O_2$ with the ore pulp and the differences in concentration ensuing therefrom and, where an oxygen electrode chain is used, its long response time; an excessively slow addition of $H_2O_2$ may extend the leaching time whereas an excess of $H_2O_2$ adversely affects the economy of the process on account of the then possible oxidation of the cyanide.

According to the invention, an economic addition of the $H_2O_2$ solution which is applicable in continuous and non-continuous leaching processes comprises branching off from the main stream of the ore-free leaching solution or of the leaching solution containing ores to be leached a very small measuring stream by comparison with the main stream, adding aqueous $H_2O_2$ solution to this measuring stream in a quantity controlled through the desired value of the $O_2$ concentration as measured in the measuring stream at a constant pH value selected from 8 to 13 and, at the same time, adding an aqueous $H_2O_2$ solution to the main stream in a proportional quantity. In general, an $H_2O_2$ solution of the same concentration will be added to the measuring stream and to the main stream. In order exactly to determine the $O_2$ concentration, the pH value is measured in the measuring stream and is kept constant by addition of, in general, a lye, for example soda lye. If necessary, pH adjustment/stabilization in the main stream of the ore pulp or of the ore-free leaching solution will also be regulated through this pH measurement in the measuring stream.

In another particularly advantageous embodiment of the control of the addition of $H_2O_2$ through measurement of the $O_2$ concentration in a measuring stream, a dilute aqueous manganese(II) salt solution, for example manganese sulfate, is continuously introduced into the measuring stream in such a quantity that the $O_2$ concentration is measured in the presence of 0.1 to 50 mg and preferably in the presence of from 0.5 to 10 mg manganese ions per liter of the aqueous phase of the measuring stream. This addition of Mn ions accelerates the decomposition of the $H_2O_2$ and thus provides for rapid determination of the $O_2$ concentration available from the addition of $H_2O_2$, as required for safe control. Instead of Mn ions, it is also possible to use other metal compounds which catalyze the decomposition of $H_2O_2$. In this way, it is possible where an $O_2$ electrode chain is used to shorten the delay in the indication to less than 1 minute.

In this embodiment, the $O_2$ concentration in the measuring stream does not have to be identical with that in the main stream. Instead, the $O_2$ concentration produced by the catalytically accelerated decomposition of $H_2O_2$ indicates the available quantity of active oxygen.

The process according to the invention may be used, for example, both in heap leaching and in leaching by agitation. In the case of heap leaching, the $O_2$ concentration in the leaching solution before it percolates through the ore pile will be adjusted by the addition—controlled in accordance with the invention—of $H_2O_2$ to the leaching solution, which may even be made in a measuring stream. Through the slow decomposition of the $H_2O_2$ present in a very low concentration in the leaching solution, it is possible in heap leaching to keep the $O_2$ content of the leaching solution at an effective $O_2$ concentration level, even in the lower regions of the ore pile, and hence to accelerate the leaching process and to increase the yield of noble metal.

One particularly advantageous embodiment of the invention as applied, for example, to leaching by agitation is described in detail in the following with reference to the accompanying diagrammatic drawing (FIG. 1):

The plant contains the leaching tank (1) which holds the ore pulp, a very small measuring cell (2) compared with the leaching tank, a mixer (3) for preparing and holding the dilute, for example 1–2% by weight, $H_2O_2$ solution from, for example, 70% $H_2O_2$ being charged through line (16) and water being charged through line (17). Storage containers are provided for the Mn(II) salt solution (4) and lye (18) (for example soda lye). Also provided is a pH meter (5), metering pumps (6) and (7) for the addition of an aqueous leaching solution to the measuring cell and to the leaching tank, a control unit (8) for regulating addition of the lye, an $O_2$ electrode chain (9), metering pumps (10) and (11) for the addition of $H_2O_2$ to the measuring cell and to the leaching tank, and a control unit (12) for controlling the addition of $H_2O_2$. Pipes are included for introducing (13) the fresh ore pulp and removing (14) the leached ore pulp and for introducing (15) and removing (15*a*) the measuring stream.

To carry out leaching by agitation continuously in accordance with the invention, a measuring stream is continuously branched off from the leaching tank (1) and fed to the measuring cell (2) through the pipe 15. An ore pulp measuring stream (for example 100 l/h) flows continuously through the measuring cell, for example in the form of a stirring vessel, and back into the tank (1) through the pipe (15*a*). The pH meter (5) controls a membrane metering pump (6) for the addition of lye through the unit (8) The pH value is kept constant between pH 9 and pH 12. If necessary, the pulse frequency of the metering pump (6) is converted by a frequency converter into a signal current which is used for the quantitatively proportional addition of lye by the metering pump (7). An Mn(II) salt solution, preferably having a concentration of from 50 to 100 mg $Mn^{2+}$/l solution, is introduced continuously into the measuring stream at a rate of approximately 1 l/h, the point of introduction best being situated at the entrance to the measuring cell. The addition of the dilute $H_2O_2$ solution is regulated through an oxygen electrode chain (9) which controls a membrane pump (10) through the control unit comprising a transducer (12). The prescribed value for the $O_2$ concentration, which is preferably in the range from 7 to 13 mg $O_2$/l of aqueous phase, is stored in the transducer (in 12). The pulse frequency of the metering pump (10) is converted by a frequency converter (in 12) into a signal current which is used to control the metering pump (11) for the addition of the $H_2O_2$ solution to the leaching tank (1) using the quantities of ore pulp flowing through (1) and (2). The point where the $H_2O_2$ is introduced into (1) is situated in a position which guarantees rapid intermixing (high turbulence).

The advantageous embodiment shown in FIG. 1 may also be used in slightly modified form for heap leaching, in which case (1) is a container holding the continuously pump-circulated leaching solution and (13) is the point of entry of the leaching solution low in oxygen and (14) the exit of the leaching solution enriched with $H_2O_2$ which is used to spray the ore pile. The measuring stream is ore-free.

As shown in the foregoing and as can be seen from the examples that follow, the process according to the invention can be carried out much more economically than the hitherto known process with addition of $H_2O_2$, is flexible in its application and may be safely controlled. Another advantage over the conventional leaching process where air is used for gassing is that there are no losses of NaCN, the operating costs for gassing with air are eliminated and, for the same gold yield, the leaching time in some cases, is considerably shorter, enabling the plant to be better utilized. Compared with conventional heap leaching, the use of $H_2O_2$ in accordance with the invention enables the gold yield to be increased and the leaching time to be shortened.

The process according to the invention may be used with particular advantage in the continuous leaching processes used in the mining industry.

EXAMPLE 1—(COMPARISON EXAMPLE)

a) Leaching with Single Addition of $H_2O_2$

The porphyritic gold ore originated from South East Asia and contained 6.2 ppm Au, 8 ppm Ag, 840 ppm Cu and 17300 ppm Fe. The ore had been ground to a fineness below 400 μm.

An ore pulp having a solids content of 40% was prepared in a 2-liter glass beaker equipped with a stirrer. The NaCN content, based on the aqueous phase, was 0.033% by weight while the pH value adjusted with CaO was 11.0. $H_2O_2$ in the form of a 35% solution was added once with thorough stirring of the pulp (300 r.p.m.), but without inclusion of air, in a quantity corresponding to an $H_2O_2$ concentration in the aqueous phase of the pulp of 0.023%. After 24 hours, the gold yield was 46% of the theoretical.

b) Leaching with air as oxidizing agent

In the apparatus described above, the same ore pulp having a NaCN concentration of 0.033% by weight, based on the aqueous phase, was leached at pH 11. The ore pulp was gassed with 20 liters of air per kg pulp per hour through a gas diffusor plate. The gold yield was 20% after 1 hour, 45% after 4 hours and 93% after 24 hours.

EXAMPLE 2

Leaching with addition of $H_2O_2$ in accordance with the invention, gold ore from South East Asia; ore pulp with a solids content of 40% by weight.

Leaching was carried out in a 2-liter glass beaker equipped with a propeller stirrer (300 r.p.m.). To control the leaching process, the pH value was measured through a combined pH glass electrode and, by means of a controller (Dulcometer CFG type PHS 014), a membrane metering pump was controlled, the soda lye (20 g NaOH/l) was introduced and the pH value kept constant at 11.0. The concentration of dissolved oxygen was followed by means of an oxygen electrode chain with an associated measuring unit ($O_2$ electrode WTW EO 190-1.5, $O_2$ meter WTW OX 191) and a membrane metering pump introducing $H_2O_2$ was controlled by means of a controller (Dulcometer CFG type RHS 2000). The prescribed value was 12 mg $O_2$/l of aqueous phase. In view of the slow response time of the electrode, the $O_2$ concentration varied between 10.5 and 13.5 mg $O_2$/l, although a minimum slope of the proportional controller on approaching the prescribed value was used.

The same ore as in Example 1 was leached. The NaCN concentration of the leaching solution at the beginning was again 0.033% by weight and the pH value was kept constant at 11.0 by addition of soda lye. The leaching time was again 24 hours. Hydrogen peroxide was added during leaching in various concentrations, namely 1.0% by weight, 3.5% by weight and 35% by weight, the concentration of dissolved $O_2$ being kept at 12 mg/l. The results are shown in the following table:

| $H_2O_2$ concentration added (% by weight) | Consumption of $H_2O_2$, 35% by weight, per kg ore (ml/kg) |
|---|---|
| 35 | 21.2 |
| 3.5 | 5.0 |

-continued

| $H_2O_2$ concentration added (% by weight) | Consumption of $H_2O_2$, 35% by weight, per kg ore (ml/kg) |
|---|---|
| 1 | 1.9 |

The gold yield is around 90% at all the $H_2O_2$ concentrations investigated.

In the first phase of the leaching process, the gold dissolved more quickly than in the conventional process using air for gassing.

The control system produced a periodic variation in the $O_2$ concentration. With decreasing $H_2O_2$ concentration, the addition time became longer although the variations around the prescribed value became smaller, so that better control was possible.

EXAMPLE 3

Leaching of a gold ore from South Africa—comparison of the conventional process where air is used for gassing a) with the process according to the invention using $H_2O_2$ as oxidizing agent b):

a) The ore pulp which had a solids content of 63%, a pH value adjusted with CaO of 11.3 and an initial NaCN concentration of 0.06% by weight, based on the aqueous phase, proved to be "oxygen-repellent" in conventional leaching with air gassing, but not an "oxygen consumer" because the total consumption of active oxygen was low. By vigorous gassing with air, the oxygen content of the pulp could only be increased to 4.3 mg $O_2$ per liter aqueous phase in the laboratory apparatus; the maximum content was reached after 1 hour.

Where air was used for gassing (20 l/h/kg pulp), the gold yield was 84% after 4 hours and 89% after 24 hours; the consumption of NaCN was 0.30 kg/t ore.

b) In the apparatus described in Example 2, leaching was carried out with addition of 0.5 to 5% by weight hydrogen peroxide solution in accordance with the invention. The NaCN content was 0.06% by weight, based on the aqueous phase. The pH value was adjusted to 11.2 with CaO and was kept constant by the controlled addition of 0.5N NaOH. The solids content was approximately 60%, the $O_2$ concentration (prescribed value) 12 mg $O_2$/l of aqueous phase and the leaching time 24 hours.

| $H_2O_2$ concentration (% by weight) | Gold yield (%) after 4 hours | NaCN consumption (Kg/t one) after 24 hours | $H_2O_2$ consumption, calculated 1% by weight, in l per t ore per day |
|---|---|---|---|
| 0.5 | 91 | 0.27 | 61 |
| 1.0 | 92 | 0.33 | 40 |
| 2.0 | 90 | 0.30 | 127 |
| 5.0 | 90 | 0.31 | 156 |

Where 1.0% by weight $H_2O_2$ was used, the prescribed oxygen concentration was reached after 14 minutes. The maximum gold yield of 90 to 92% was obtained after only 4 hours, irrespective of the $H_2O_2$ concentration used.

Example 3 clearly illustrates the advantages of the process according to the invention; to wit, it is possible to control the system by increasing the $O_2$ to a higher level in the pulp and to reach that level more quickly. The addition of $H_2O_2$ can be safely controlled, resulting in a minimal and hence economic consumption of oxidizing agent. The gold yield and NaCN consumption are comparable in both processes, possibly with a slightly higher gold yield in the case of oxidation with $H_2O_2$. Shorter leaching times provide for a greater throughput of ore and for better utilization of the plant capacity.

As the term is used herein, "an aqueous cyanide-containing solution" means one containing NaCN or some equivalent cyanide contributing compound. Such solutions are well known in the art and any suitable one can be used for purposes of this invention.

In like manner, $H_2O_2$ or a compound capable of releasing $H_2O_2$ can be used for purposes of this invention wherever the term "$H_2O_2$" or "hydrogen peroxide" is used.

Further variations and modifications of the present invention will be apparent to those skilled in the art from a consideration of the foregoing and are intended to be encompassed by the appended claims.

German priority document P 36 37 082.7-24 is relied on and incorporated by reference.

We claim:

1. A process for leaching gold and silver from noble metal containing material; namely, ores or ore concentrates comprising leaching said material with an aqueous cyanide leaching solution having a pH of from 8 to 13 and adding a diluted aqueous $H_2O_2$ solution containing from 0.5 to 5% by weight $H_2O_2$ to said leaching solution during said leaching, said aqueous $H_2O_2$ solution being added in a quantity so that the dissolved $O_2$ concentration determined by measuring the dissolved $O_2$ concentration in said leaching solution is in a range from 2 to 20 mg per liter in the leaching solution during the leaching, and the $H_2O_2$ concentration in the leaching solution is below 0.02% by weight.

2. The process as claimed in claim 1, wherein said dissolved $O_2$ concentration ranges from 7 to 13 mg per liter of leaching solution.

3. The process as claimed in claim 1, further comprising branching a measuring stream off from a main stream of said leaching solution, adding said diluted aqueous $H_2O_2$ solution to said measuring stream in a quantity according to said dissolved $O_2$ concentration as determined by measuring the $O_2$ concentration with an oxygen electrode chain in said measuring stream at a pH of from 8 to 13 and, at the same time, adding diluted aqueous $H_2O_2$ solution to said main stream in a quantity that is proportional tot he $H_2O_2$ added to said measuring stream so that the $O_2$ concentration in the main stream during leaching is in the range of 2 to 20 mg per liter of the leaching solution.

4. The process as claimed in claim 3, wherein said measuring stream branched off contains ore pulp.

5. The process as claimed in claim 3, wherein said measuring stream branched off is from a continuously pump-circulated ore-free leaching solution of a heap leaching process.

6. The process as claimed in claim 1 comprising carrying out leaching in the presence of atmospheric oxygen dissolved in the leaching solution.

7. The process as claimed in claim 1, wherein the diluted $H_2O_2$ solution contains from 1 to 2% by weight $H_2O_2$.

8. A process for leaching gold and silver from noble metal containing material; namely, ores or ore concentrates comprising agitation leaching said material with an aqueous cyanide leaching solution having a pH of from 8 to 13, adding a diluted aqueous $H_2O_2$ solution containing from 0.5 to 5 weight % $H_2O_2$ to said leaching solution during said leaching, the amount of said aqueous $H_2O_2$ solution added being determined by measuring the dissolved $O_2$ concentration in said leaching solution using an oxygen electrode chain, said $O_2$ concentration in said leaching solution during said leaching ranging from 7 to 13 mg per liter leaching solution, by branching a measuring stream off from a main stream of said leaching solution which contains ores as ore pulp to be leached, adding the diluted aqueous $H_2O_2$ solution to said measuring stream in a quantity according to said $O_2$ concentration as determined by the $O_2$ concentration measured in said measuring stream at a pH from 8 to 13 and at the same time adding a diluted aqueous $H_2O_2$ solution to said main stream in a quantity that is proportional to the $H_2O_2$ added to said measuring stream so that the $O_2$ concentration in said main stream is in the range of 7 to 13 mg per liter leaching solution during leaching, and continuously adding an aqueous Mn (II) salt solution to said measuring stream, wherein the $O_2$ concentration is measured by said oxygen electrode chain in the presence of from 0.1 to 50 mg Mn ions per liter of the aqueous phase of said measuring stream, and wherein the $H_2O_2$ concentration in said leaching solution is kept below 0.02% by weight.

9. The process as claimed in claim 8, wherein from 0.5 to 10 mg Mn ions are present per liter of the aqueous phase of the measuring stream.

10. The process as claimed in claim 8, wherein the pH is measured in said measuring stream and is kept constant by adding soda lye thereto.

11. A process for heap leaching gold and silver from noble metal containing material; namely, ores or ore concentrates comprising adding an aqueous cyanide leaching solution having a pH of from 8 to 13 to said material, adding an aqueous $H_2O_2$ solution to said leaching solution during said leaching, said aqueous $H_2O_2$ solution being added in a quantity so that the dissolved $O_2$ concentration in said leaching solution determined by measuring using an oxygen electrode chain is in the range of from 7 to 13 mg per liter of the leaching solution, by branching a measuring stream off from the main stream of the leaching solution which is ore-free, adding an aqueous $H_2O_2$ solution to said measuring stream in a quantity according to said dissolved $O_2$ concentration as determined by the $O_2$ concentration measured in said measuring stream at a pH from 8 to 13, and at the same time, adding aqueous $H_2O_2$ solution to said main stream in a quantity that is proportional to the $H_2O_2$ added to said measuring stream so that the $O_2$ concentration in said main stream is in said range during leaching, and continuously adding an Mn (II) salt solution to said measuring stream wherein the $O_2$ concentration is measured by said oxygen electrode chain in the presence of from 0.1 to 50 mg Mn ions per liter of the aqueous phase of said measuring stream, and wherein the $H_2O_2$ concentration in said leaching solution is kept below 0.02% by weight.

12. The process as claimed in claim 11, wherein from 0.5 to 10 mg Mn ions are present per liter of the aqueous phase of said measuring stream.

13. The process as claimed in claim 11, wherein the pH is measured in said measuring stream and is kept constant by adding soda lye to said measuring stream.

14. A process for leaching gold and silver from noble metal containing material; namely, ores or ore concentrates comprising leaching said material with an aqueous cyanide leaching solution having a pH of from 8 to 13 and adding during leaching a diluted aqueous $H_2O_2$ solution containing from 0.5 to 5% by weight $H_2O_2$ to said leaching solution, said adding being carried out by branching a measuring stream off from a main stream of said leaching solution, adding said diluted aqueous $H_2O_2$ solution to said measuring stream in a quantity to obtain a desired dissolved $O_2$ concentration of from 2 to 20 mg per liter of the leaching solution as determined by measuring the dissolved $O_2$ concentration with an oxygen electrode chain in said measuring stream at a pH of from 8 to 13 and, at the same time, adding diluted aqueous $H_2O_2$ solution to said main stream in a quantity that is proportional to the $H_2O_2$ added to said measuring stream so that the $O_2$ concentration in the main stream is in a range from 2 to 20 mg per liter of the leaching solution during leaching, the $H_2O_2$ concentration in the leaching solution being below 0.02% by weight, and further comprising continuously adding an aqueous Mn(II) salt solution to the said measuring stream and measuring the $O_2$ concentration by an oxygen electrode chain in the presence of from 0.1 to 50 mg Mn ions per liter of the aqueous phase of the measuring stream.

15. The process as claimed in claim 14, wherein from 0.5 to 10 mg Mn ions per liter of the aqueous phase is added.

* * * * *